US005988747A

United States Patent [19]

Jeans

[11] Patent Number: 5,988,747

[45] Date of Patent: Nov. 23, 1999

[54] INFLATABLE LIFTING DEVICE AND CONTROL APPARATUS THEREFOR

[76] Inventor: Edward Lewis Jeans, Kydart House, Monmouth, Monmouthshire NP5 4RJ, United Kingdom

[21] Appl. No.: 08/945,454

[22] PCT Filed: Apr. 25, 1996

[86] PCT No.: PCT/GB96/01001

§ 371 Date: Oct. 24, 1997

§ 102(e) Date: Oct. 24, 1997

[87] PCT Pub. No.: WO96/33685

PCT Pub. Date: Oct. 31, 1996

[30] Foreign Application Priority Data

Apr. 25, 1995 [GB] United Kingdom ..... 9508415

[51] Int. Cl.[6] ..... A61G 5/14

[52] U.S. Cl. ..... 297/313; 297/DIG. 10; 297/452.41; 297/256.13; 5/655.3; 5/654

[58] Field of Search ..... 297/284.3, 312, 297/313, 452.41, DIG. 10, 256.13; 5/654, 655.3, 715

[56] References Cited

U.S. PATENT DOCUMENTS

| | | | |
|---|---|---|---|
| 3,330,598 | 7/1967 | Whiteside | 297/284.3 |
| 3,982,786 | 9/1976 | Burgin et al. | 297/284.3 |
| 3,984,886 | 10/1976 | Keeton | 297/284.3 |
| 4,514,010 | 4/1985 | Gonzalez | 297/452.41 X |
| 4,915,124 | 4/1990 | Sember, III | 5/655.3 X |
| 5,184,365 | 2/1993 | Stafford | 5/715 X |
| 5,361,433 | 11/1994 | Vanzant | 297/DIG. 10 |
| 5,375,910 | 12/1994 | Murphy | 297/DIG. 10 |

FOREIGN PATENT DOCUMENTS

WO 93/24072 12/1993 WIPO .

*Primary Examiner*—Peter R. Brown
*Attorney, Agent, or Firm*—Klauber & Jackson

[57] ABSTRACT

A seating device which comprises an inflatable seat (4) and an inflating means which provides for the controlled inflation and deflation of the seat. The seat (4) comprises a chamber defined by top, bottom and side walls (12, 13) which is connected to the inflation means. The inflation means comprises a motorised fan unit (20) and a control valve (6) connected by a supply pipe (10) to the seat (4). The device is inflatable from a deflated position on the base of a support surface such as a bath to an inflated position adjacent the rim of the bath such that a person sitting thereon can easily enter or exit the bath to bathe. The device is of particular use for handicapped or elderly persons and does not require mechanical actuation means and has sufficient inflatable characteristic to enable the seat to remain in a fixed position in relation to the bath.

23 Claims, 5 Drawing Sheets

INFLATABLE LIFTING DEVICE AND CONTROL APPARATUS THEREFOR

The present invention relates to a lifting device particularly, but not exclusively for the lifting of a person and typically an elderly, infirm or injured person such that they can move from and onto an object. Such objects can be any of a chair, bath or bed.

At the present time there are several mechanical devices available to aid in the lifting of a person to and from an object. However the mechanical devices are necessarily bulky due to the fact that in order to be able to safely support the weight of the person being lifted they are required to have a relatively large base to ensure that the device does not topple over upon bearing the weight of the person. The size of these devices therefore leads to problems with their use in areas where space is restricted such as in hospital wards, convalescing homes, bathrooms, bedrooms and such like. This has meant that a considerable proportion of the lifting of persons is still undertaken manually as the devices available are either too bulky to be used or the time taken using the devices is regarded as being excessively long.

In an attempt to reduce these problems co-pending application No PCT/G93/01104 discloses the use of an inflatable seating device and control means therefore for use in lifting and lowering a person such as lifting the person to and from a bath. The inflatable seat is manufactured with a single chamber with walls made from a plastics material and allows inflation from a flattened position where the person can sit in the bath to an inflated position where the person is raised to the rim of the bath so that they can then leave the same. This seat relies upon contact with the side walls of the bath, to add to the stability of the device. The need for stability is important as the seating area is relatively small compared to the height of the device when inflated and the use of the side wall contact ensures that the same is guided such that the raising and lowering of the person sitting on the seat during deflation and inflation is smooth and thus the person sitting on the same feels safe. It has been found that this inflatable seat, although operable successfully when side contact walls are provided is prone to inflate and deflate in an unsatisfactory and irregular manner when no such support walls are available or the size of the seating area relative to the inflated height is increased. This can lead to the person sitting on the device becoming unbalanced and the feeling of security, which is important to persons who may be infirm and unable to support themselves, is lost. One alternative is to provide a seat comprising a number of compartments as shown in U.S. Pat. No. 3,330,558. However in this type of seat each compartment is independently adjustable so as to offer variation in pressure for comfort purposes. This seat does not allow control of the inflation and deflation of the seat in a balanced fashion and control relative to the pressure in the other compartments of the seat.

The aim of the present invention is to provide an inflatable seat which can be used to raise and lower persons sitting thereon without the need for supporting walls to be present and to allow the device to be operable for relatively shallow lifting operations and to provide the seat and control means therefore, in a manner which allows the person sitting thereon to be raised and lowered in a relatively smooth and balanced fashion.

The present invention provides in a first aspect of the invention a lifting means apparatus including an inflatable seat (2) for the lifting and lowering of a person sitting thereon, said inflatable seat device comprising at least two inflatable compartments (14) and characterised in that the lifting means includes a flow control system (12, 13', 13"), for controlling the inflation and/or deflation of each of the compartments (14) such that the relative rate of inflation and/or deflation of a compartment at any one time is dependent upon the pressure fluid in that compartment and the pressure of fluid in the other compartments of the inflatable seat.

Typically the system provided for controlling the inflation and/or deflation of each of the compartments is such that the relative rate of inflation and/or deflation of a compartment at any one time is dependent upon the pressure in that compartment at that instant and the pressure of fluid in the other compartments of the inflatable seat.

In one feature the surfaces of the inflatable seat upon which the person sits are shaped so as to encourage the person to sit comfortably in the centre of the seat and/or is preferably shaped such that a two stage action is applied to the person in contact therewith so that, upon inflation, the person is lifted and then in the second stage moved forward towards a standing position.

Typically the inflatable seat device is connected to control means and an inflating device to control the inflation and deflation of the compartments in the same. The control means include a flow valve and preferably a control valve as disclosed in co-pending application PCT/GB93/01104.

In one embodiment the flow valve is connected via a connecting feed to each of the compartments of the inflatable seat device, for example when the device includes two compartents the flow valve is connected to a connecting feed to each of the compartments.

In one embodiment the valve preferably includes an inlet port through which the inflating fluid enters the same, and outlets through which the fluid passes into connecting feeds and into the compartments to be inflated. Upon deflation the fluid passes from the compartments through the connecting feeds to exit the apparatus via at least one exit aperture.

In one embodiment each connecting feed is provided with a flow control means to control the flow of fluid from the compartments during deflation of the device and are arranged to be fully open during inflation but during deflation the flow control means for any one compartment which has a high fluid pressure relative to the other compartment acts to restrict the connecting feed thereby the amount of fluid which can exit from that compartment is restricted such that the compartment with the relatively lower pressure can release fluid at the greater rate and the compartment with the relatively higher fluid pressure releases fluid at a lower rate until an equilibrium is reached with the fluid pressures in the compartments substantially level.

In a further embodiment the flow valve is preferably designed to allow the compartment which has the highest fluid pressure at any instance to receive the greater proportion of inflating fluid and the compartment with the lowest fluid pressure to receive the smaller proportion of inflating fluid at any instant.

By providing the flow valve and associated flow control means to operate as described so the person sitting on the inflatable seat device during inflation and deflation can be maintained in a relatively level plane thereby ensuring smooth movement and a feeling of security.

In one embodiment the flow valve includes a flexible diaphragm arranged to flex according to the pressures exerted thereon by the fluid pressure in each of the inflatable seat compartments and thereby allow control of inflation and/or deflation of the seat compartments. Preferably the flow valve outlets and inlets are provided with check valves to ensure that they can only be opened during deflation and inflation respectively thereby preventing uncontrolled leakage of fluid.

If no check valve is provided the inlet to the flow valve is smaller than the connecting feeds to the compartments thus created during inflation a back pressure to cause manipulation of the proportioning diaphragm.

In one preferred embodiment the diaphragm carries a stop valve assembly including a frustoconically shaped valve stop for each of the compartments. If two compartments are provided in the device two frustoconical stops are provided, one on each side of the diaphragm. In this arrangement the valve stops move with the diaphragm towards one or other of the side walls of the valve depending upon the relative pressure of the fluid in the compartments to which they are connected. The valve stops are also arranged to be linearly movable in relation to the exit apertures in the side walls such that as the valve stops move to or away from the side walls of the flow valve so they selectively increase or reduce the amount of fluid which can escape through the respective exit aperture.

Typically the inflating fluid is air provided in a pressurised form by means of a blower unit connected to the flow valve via a control valve and the blower and control valve can be mounted adjacent the inflatable seat device to allow control of the same by the person sitting on the seat.

In one embodiment the compartments of the inflatable seat are interconnected to allow limited and controlled transfer of fluid between the compartments.

In a further aspect of the invention there is provided an inflatable seat comprising at least two inflatable compartments, said compartments separated by an inner wall. Each compartment is preferably independently inflatable. In one embodiment passages may be provided between the compartments to allow controlled and limited transfer of fluid between the same. Preferably the inflatable seat is made from a flexible plastics material which allows movement of the seat from the inflated to the deflated position but may, in one embodiment, be provided with a supporting framework. In a yet further feature the rear of the surface upon which the person sits is higher than the front thereby allowing a two stage action on the person during inflation such that the first stage is a conventional lifting action and the second stage is a pushing action from the rear higher surface to push the person up and forward towards a standing position.

In a yet further aspect of the invention there is provided a lifting means for a person, said lifting means comprising an inflatable seat for the lifting and lowering of a person sitting thereon and said seat provided with associated members including support arms which can be used to provide support for the person sitting on said seat.

Preferably said support arms are provided to be movable between a retracted position when the inflatable seat is in a deflated condition and an extended position when the seat is inflated and, in each position provide support for the person sitting on said seat.

Typically the support arms are connected to the seat and arranged to be movable with the seat as it moves between inflated and deflated conditions.

In one embodiment the seat further includes a frame for contacting a surface and providing additional stability and/or mobility and said frame can be adjustable to allow the same to be fitted to, and used in, existing chairs.

Typically the inflatable seat comprises at least two compartments, the inflation and/or deflation of which is controlled by a flow valve and control valve connected to a blower unit, by a pipe.

Specific embodiments of the invention will now be described with reference to the accompanying drawings wherein.

Figure 1:
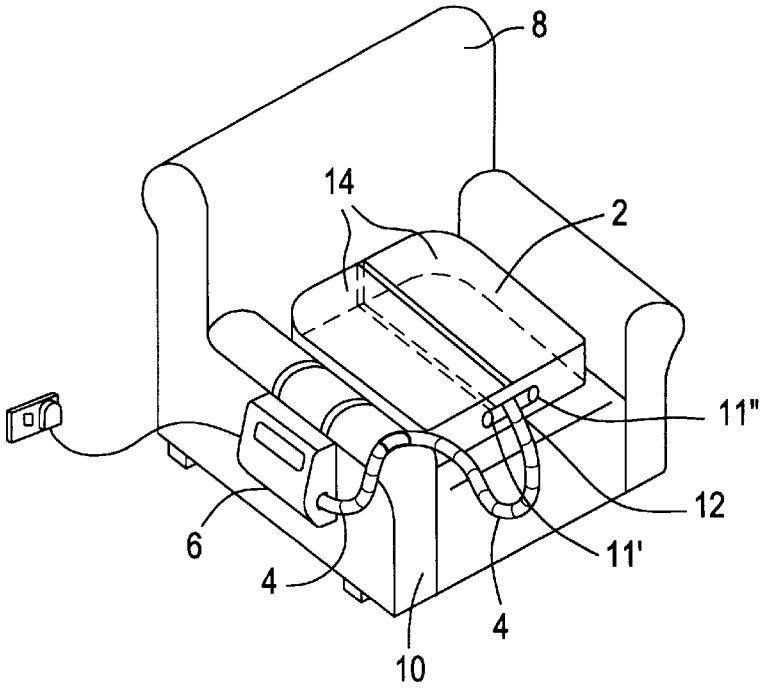
FIG. 1 illustrates a perspective view of the apparatus of the invention in a first embodiment and in use.
Figure 2A:
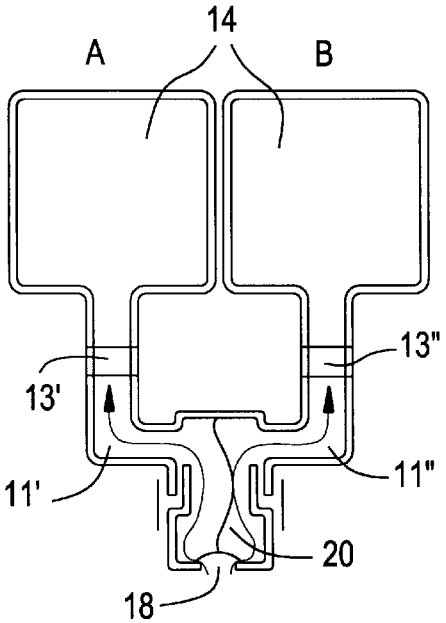
FIGS. 2A and 2B illustrate in diagrammatic form the flow valve in inflating and deflating positions respectively.
Figure 2B:
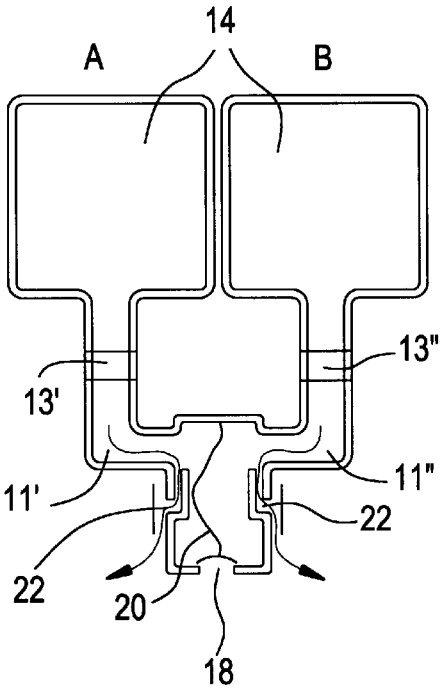

Referring firstly to FIG. 1 there is shown the lifting means apparatus of the invention in one embodiment. The apparatus comprises an inflatable seat 2 to which is connected a fluid supply pipe 4 which connects the seat device 2 to a fluid blower unit 6 and for the purpose of the description the fluid is air. The blower unit is electrically powered and can be mounted as shown an the chair 8, upon which the inflatable seat 2 is to be used. At a position intermediate the air blower unit and the inflatable seat 2 on the air supply pipe 4 there is provided a control valve 10 which is manually operable by the user of the apparatus to cause any of deflation, inflation and maintained condition of the inflatable seat. This control valve is described in more detail in co-pending application No PCT/GB93/01104 and acts in conjunction with the air blower unit to provide the required control of the supply of fluid to the seat 2. Also provided on the air supply pipe 4 at the interface between the pipe and the inflatable seat 2 is a flow valve 12 connected via connecting feeds 11', 11" to the seat compartments 14. This valve serves to connect each of the compartments 14 in the inflatable seat device 2 to the air supply pipe 4. Referring now to FIGS. 2A and 2B an embodiment of the flow valve is shown in more detail wherein flow control means 13', 13", are provided with one of each on the connecting feeds, 11', 11". The flow control means act to allow control of the deflation of each compartment relative to the other compartments and to the differential in the pressure of air between each of the compartments, caused, for example, by the person on the seat sitting more heavily on one compartment than the other. The provision of the flow valve therefore allows the inflation and deflation of the compartments to be controlled.

The relationship between the flow valve 12, the connecting feeds 11', 11", flow control means 13', 13" and the compartments 14 when in inflating and deflating positions in this embodiment is such that the valve 12 is connected to a two compartment inflatable seat 2 and the valve 12 is provided with two connecting feeds 11', 11" which connect the inlet port 18, through which air from the air supply pipe 4 enters, with the compartments 14 via the flow control means 13', 13". The flow valve 12 includes a flexible diaphragm 20 which is mounted to flex according to the pressure of air acting thereon and also includes at least one, one way air exit aperture 22 through which air exits to allow deflation.

Figure 3:
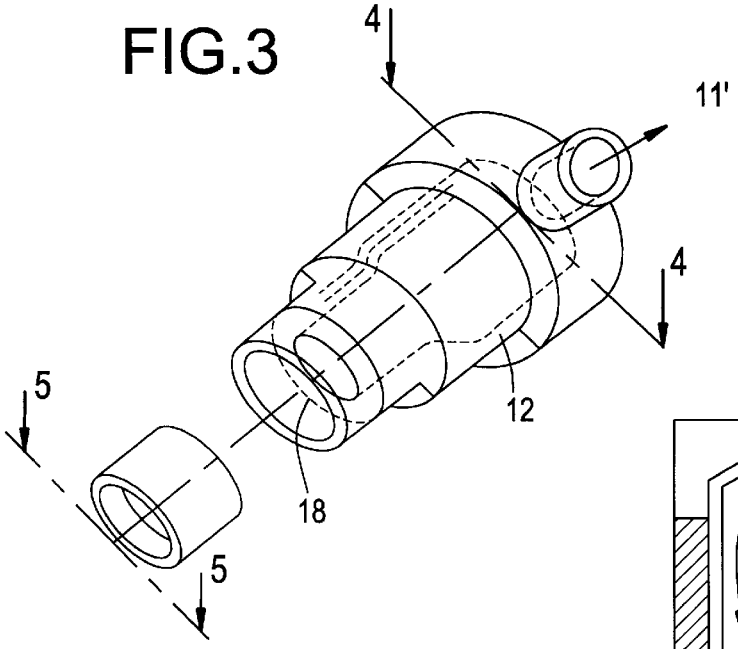
FIG. 3 illustrates a perspective view of the flow valve in one embodiment.
Figure 4:
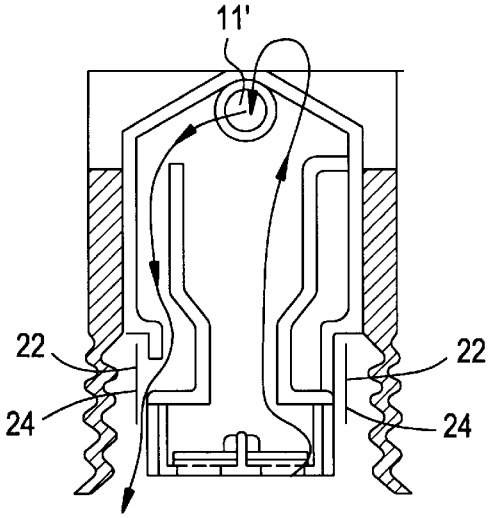
FIG. 4 illustrates the valve of FIG. 3 in cross section along line A—A.
Figure 5:
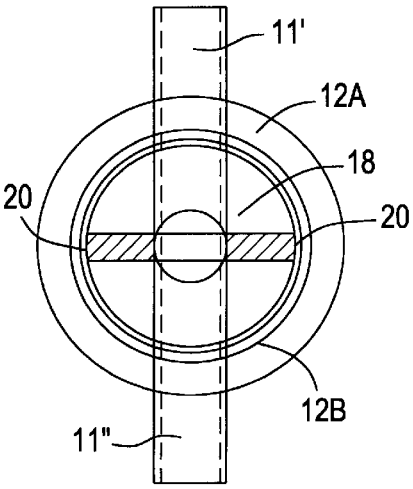
FIG. 5 illustrates the valve of FIGS. 3 and 4 in plan.

FIGS. 3, 4 and 5 all illustrate various views of a first embodiment of a flow valve 12 wherein the inlet 18 and connecting feeds 11', 11" are shown. Also shown in FIG. 4 is the exit aperture 22. The exit aperture 22 is normally sealed to prevent the ingress of air through this uncontrolled route during inflation and is sealed by the provision of a sealing band 24. The band is provided with a degree of elasticity such that when the control valve is set to the deflation position and the inlet 18 of the flow valve closed and deflation commences, the pressure of air which is attempting to escape the valve is sufficient to blow the band away from the exit aperture 22 to an extent to allow the fluid to escape the device and deflation to occur.

In construction, the flow valve 12 is formed of two halves 12*a* and 12*b* as shown in FIG. 5. The flexible diaphragm 20 is held in position between the two halves such that the same can not be released from its position integral with the halves. The diaphragm also splits the inlet 18 and the air entering the valve into two paths, a first path directed to a first compartment and a second path directed to a second compartment of the inflatable seat. As the pressure of air in each path alters according to the pressure in the compartment so the size of each path and the amount of air which can pass there through is altered by the flexing of the diaphragm away from the path and compartment which has the higher pressure. During inflation this deflection allows the higher pressure compartment to be supplied with a greater amount of air than the other thereby increasing the inflation of that compartment to raise it toward the level of the other and thereby alter the position of the person thereon an equilibrium position. When no check valve is provided the dimensions of the inlet 18 are smaller than each connecting feed 11', 11" thereby providing unequal back pressure on each side of the diaphragm which is proportional to the variation in pressure between the compartments and this allows the system to operate effectively.

Figure 6:
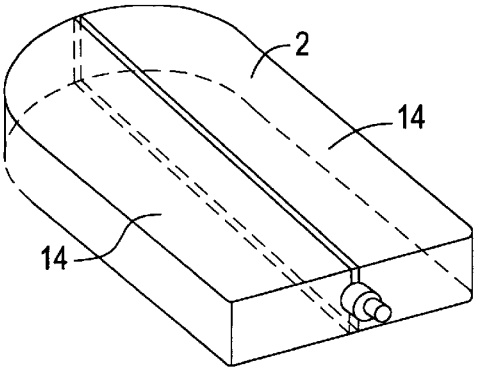
FIG. 6 illustrates the flatable seat of the device in one embodiment.

FIG. 6 illustrates the inflatable seat device 2 in one embodiment of the invention which is seen to comprise two compartments 14. The provision of an inflatable seat device having more than one compartment allows the seat to be more easily controlled and allows the seat to be more stable during inflation. However, when the device is in use during inflation or deflation the pressure on the air in one of the compartments can be greater than in the other due to the person being lifted or lowered sitting more heavily on one compartment than the other. This would normally lead to the person tilting and lead to feelings of insecurity. The apparatus of the invention prevents this from happening.

When inflation has occurred the control valve is moved to a position whereby the fluid is held in the compartments of the device and hence the person sitting thereon is maintained in a raised position until the control valve is again altered.

In FIGS. 9, 10, 13A and 13B illustrated alternative embodiments of the seat 102, 202 wherein the surfaces 121 of the compartments 14 upon which the person sits are shaped to encourage the person to sit comfortably on the centre of the seat and thereby encourage even distribution of weight. Furthermore the compartments are shaped such that the rear of the seat area upon which the person sits is significantly higher and thereby forms upstanding portions 103, 203. In use and for example during inflation of the seat the provision of the upstanding portion allows a two stage action, the first being a lifting action on the person and the second being a pushing forward action to encourage the person to move toward a standing position.

Figure 11:
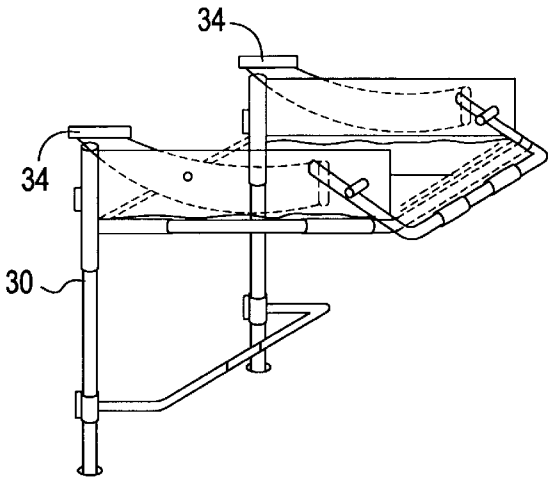
FIG. 11 illustrates an embodiment of the lifting means of FIG. 10 in a deflated condition.
Figure 10:
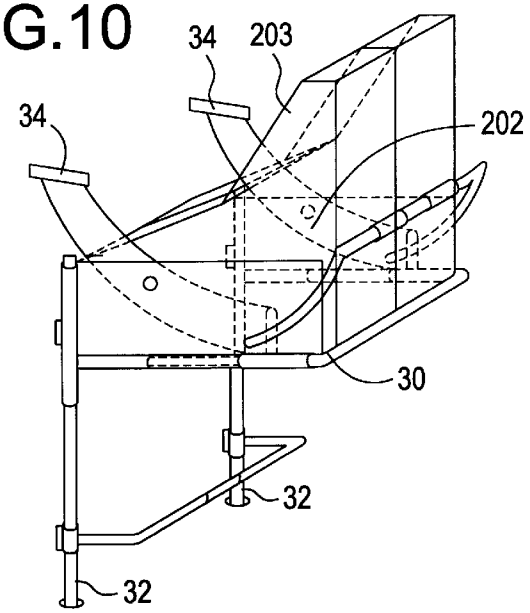
FIG. 10 illustrates an embodiment of the lifting means according to the invention with the inflatable seat in an inflated condition.
Figure 12:
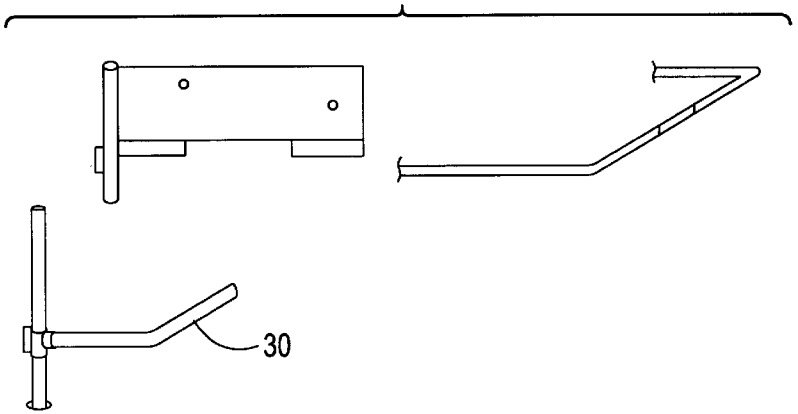
FIG. 12 illustrates part of the frame of the lifting means of FIGS. 10 and 11.

FIGS. 10–12 and 13A and B illustrate embodiments of the lifting means wherein the inflatable seat is provided with associated support arms which can be used to provide support to the person sitting on the seat. In FIGS. 10 and 11 a frame 30 is provided which locates the inflatable seat 2 in position and provided with support legs 32. The frame is adjustable as shown in FIG. 12 to allow the same to be retrofitted to existing chairs.

In FIGS. 10 and 11 the support arms 34 of the frame 30 are shown to be pivotally movable as the seat 2 moves from an inflated position as shown in FIG. 10 to a deflated position as shown in FIG. 11 thereby providing support for the person thereon in inflated and deflated positions.

Figure 13B:
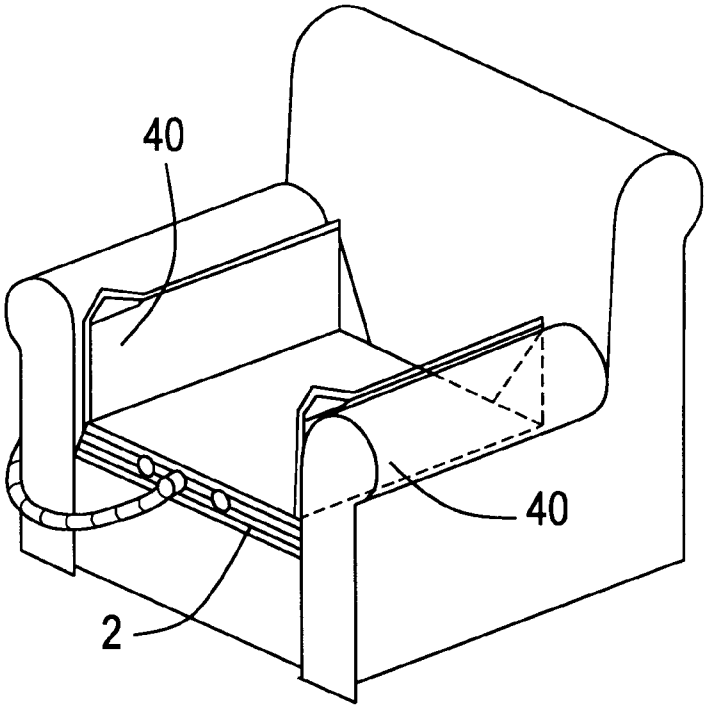
FIGS. 13A and 13B illustrate an alternative embodiment of lifting means supports.
Figure 13A:
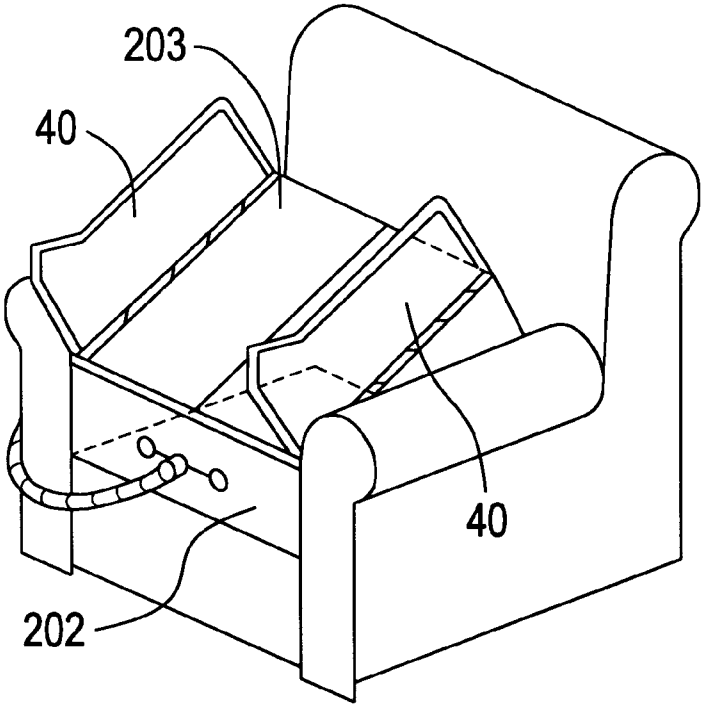

In FIGS. 13A and 13B there is shown an alternative embodiment wherein the inflatable seat 2 is provided with attached support arms 40 integral therewith. The support arms 40 are hingedly connected to the seat so as to be movable to the desired support positions when the seat is in an inflated position as shown in FIG. 13A and deflated position as shown in FIG. 13B. The support arms 40 can also include inflatable compartments if required which, typically are interconnected to compartments of the inflatable seat.

In using the embodiments of the invention herein described and during inflation the control valve 10 allows air supplied from the blower unit 6 to pass through the flow valve 12 and enter the compartments 14 of the inflatable seat device 2 via the connecting feeds 11', 11" and flow control means 13', 13" which remain fully open during inflation. If a person is sitting on one compartment more than the other then the pressure of air in the compartment which is being sat upon more is greater. This higher pressure causes the compartment to "flatten" and hence the person would be raised on a tilted plane. However, when this pressure differential occurs in the apparatus of the current invention the differential is detected by the diaphragm 20 in the flow valve 12 as shown in FIG. 2A. This detection causes the diaphragm 20 to flex to a position as shown in FIG. 2A such that the majority of air entering the valve through the inlet 18 is directed toward the high pressure compartment 14A which has air at the higher pressure and less air is directed toward the compartment 14B. Thus the increase in air supply to compartment 14A relative to compartment 14B is sufficient to allow compartment 14A to be filled at a quicker rate and thereby raise the compartment more quickly to return the seat to an equilibrium position such that the person sitting on the same is maintained in a substantially horizontal plane. If, during inflation, the person sitting on the device alters their position such that the relative pressures of the air in the compartments alter so that, for example, the air in compartment 14B has a greater pressure, the diaphragm 20 is caused to flex in the other direction by the change of back pressures of the fluid on either side of the diaphragm in the valve and thus the supply of air to compartment 14A is reduced and increasing the flow of air to compartment 14B. Thus the current invention provides a system whereby the inflation of the compartments of the inflatable seat device during inflation can be controlled to keep the person sitting on the device in a substantially level plane despite their position on the same or any change of position which they may make during inflation.

During deflation and referring to the embodiment shown in FIGS. 3–5 the diaphragm is not utilised as venting of the fluid is effected by the fluid exiting the compartments 14 into the connecting feeds 11', 11". The flow control means 13', 13' in the feeds are provided such that if the compartment to which each flow control means is connected is under higher pressure the flow control means acts to restrict the connecting feed from that compartment and hence restricts the flow of air from that compartment. The restriction of fluid flow decreases the rate of deflation of the compartment relative to the flow of air from the other compartment and hence the two compartments are brought into equilibrium such that a person sitting on the compartments during deflation is brought back into a substantially horizontal plane. Once the pressure in one particular compartment reduces so the flow control valve opens more fully. The fluid exiting the compartments passes through the connecting feeds 11', 11" to exit the device via the exit aperture 22 in the flow valve as the check valve 10 is closed during deflation.

Figure 7:
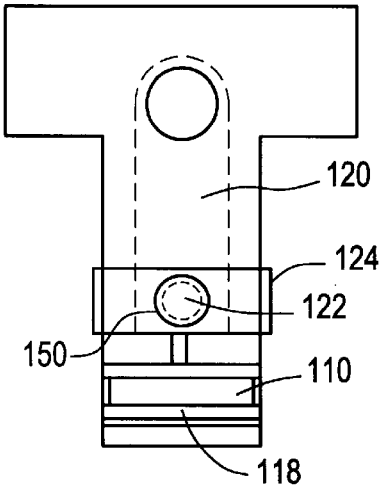
FIG. 7 illustrates a second embodiment of the flow valve in elevation.
Figure 8A:
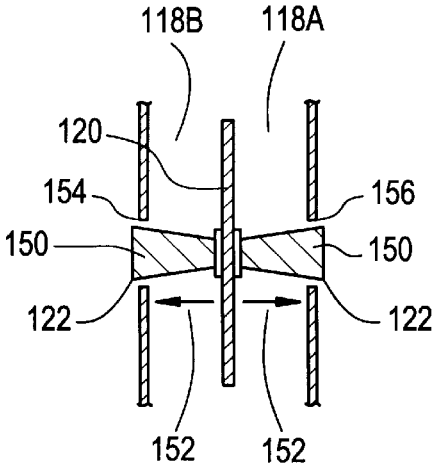
FIGS. 8A and 8B illustrate a detail of the flow valve of FIG. 7.
Figure 8B:
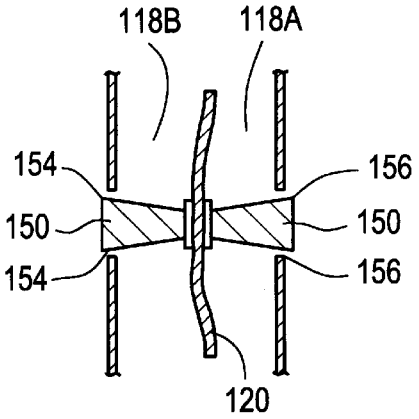
Figure 9:
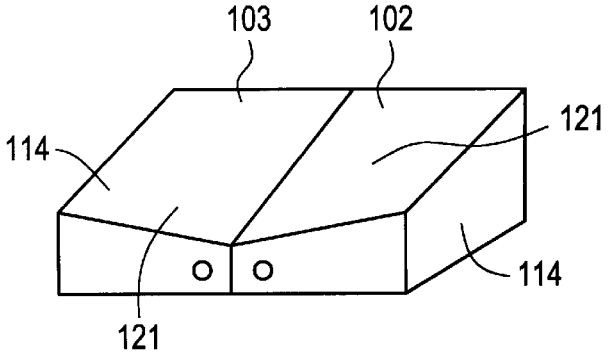
FIG. 9 illustrates a perspective view of a further embodiment of the inflatable seat device.

Referring now to the embodiment of flow valve illustrated in FIGS. 7, 8A and 8B the flow valve again comprises a diaphragm 120 which is arranged to flex dependent on the pressure of air acting on each side thereof. The flow valve is provided with an inlet 118 controlled by a check valve 110 which allows air to pass therethrough upon inflation but closes the same upon deflation where the air exits via aperture outlets 122 which are normally closed by a band 124. In this embodiment the diaphragm carries two frustoconical valve stops 150 which are arranged to lie within the exit aperture outlets 122 such that movement of the diaphragm 120 is indicated in the directions of arrows 152 causes the frustoconical valve stops to move. In FIG. 8A the valve is shown in a condition where the pressures in both compartments which are connected to the sides 118A and 118B of the valve passage have equal pressures and therefore the diaphragm 120 is not flexed and the air can exit through each of the annular spaces 154 and 156 defined between the valve stops 150 and apertures 122. In the example shown in FIG. 8B, there is a higher fluid pressure in the compartment connected to side 118A due perhaps to the person sitting more heavily on that particular compartment and this higher pressure flexes the diaphragm 120 towards the side 118B which is connected to the compartment with the lower pressure. Hence, with this movement of the diaphragm, one of the valve stops 150 is moved to increase the size of the annular space 154 defined between the valve stop 150 and one aperture 122 through which air can pass and the movement also causes the other of the frustoconical valve stops 150 to reduce the size of the annular space 156 defined between this stop 150 and the other aperture 122 and hence more air can escape from the lower pressure compartment connected to side 118B than from the higher pressure compartment connected to side 118A and this condition therefore brings the lower pressure compartment which will be higher than the higher pressure compartment towards an equilibrium whereupon the diaphragm will return to the position as shown in FIG. 8A or indeed may be caused to flex in the other direction as appropriate. This process can therefore be repeated in both directions 152 during the deflation of the seat and helps to maintain the person in a substantially horizontal plane. In this arrangement no other outlet flow control means are provided.

Upon inflation, the diaphragm 120 which is mounted along the length of the valve 112 and which carries the frustoconical valve stops 150, moves to one side or the other of the valve depending on the relative pressure of the compartments 114 of the seat 102. During inflation, and as with the flow valve 12 of FIGS. 3–5, if the pressure of one compartment is higher than the other then more air will be provided to the compartment with the higher pressure to inflate that compartment more quickly than the compartment with the lower pressure thereby bringing the person sitting on the same into a more level position and the position of the diaphragm changes as the relative pressures in the compartments change.

Upon deflation the check valve 110 is held in a closed condition and therefore no air can pass through the same and can only escape through the outlets 122 The diaphragm 120 and frustoconical stops 150 operate to ensure that if one of the compartments has a higher pressure of air then this deflates more slowly than the other compartment so that the other compartment deflates more quickly thus drawing the weight of that person onto the lower pressure compartment to bring the person sitting thereon into a level plane. This is achieved by the movement of the frustoconical stops 150 in conjunction with the outlets 122 to control the volume of air which can pass through each of the outlets 122 by altering the size of the annular spaces 154, 156. The frustoconical stops 150 are arranged in relation to the outlets 122 so that an amount of air can pass through each of the outlets at all times and this reduces the "hunting" effect which can occur if there is too substantial a change between the pressure differential in the compartments and the system is too sensitive. The amount of air which can pass through the outlets 122 is determined by the position of each of the frustoconical stops 150 relative to the respective outlets 122. The position of the same is determined by the movement of the diaphragm upon which they are mounted such that the side of the diaphragm relating to the relatively high pressure compartment is moved away from the side wall of the valve which in turn moves the frustoconical shaped part on the opposite side of the diaphragm into the outlet 122 to increase the annular space and, as the annular space of the outlet is increased due to the shape of the valve stop, so more air can escape therethrough and so more air is released from the compartment with the relatively low pressure than is possible from the compartment with the relatively high pressure. The movement also causes the wider part of the other frustoconical stop valve 150 on the side of the diaphragm relating to the high pressure compartment to move to restrict the annular space on that side to restrict the escape of the air through the other outlet 122. This diaphragm condition changes as pressure of air in the respective compartments changes and thus control of the release of the air during deflation is achieved.

The fluid used to inflate the device is referred to as air but it should be noted that the control apparatus and the principles of the same as set forth herein are equally applicable to whichever fluid is desired to be used for the purpose of inflating the compartments.

Thus the present invention provides a lifting device which comprises an inflatable seat which is formed from more than one compartment and which, when inflated or deflated causes the person sitting thereon to be raised or lowered accordingly. The provision of the control apparatus and particularly the flow valve ensures that during the inflation and/or deflation of the seat, differentials in the pressure of the fluid between the compartments is taken into account and the valve automatically adjusts to control the amount of fluid entering or leaving each compartment to bring the pressures in each compartment to adjust the rate of lift or lower and thereby maintain the person thereon in a safe, secure and balanced position during inflation and deflation.

I claim:

1. A lifting means apparatus comprising:

an inflatable seat having means for the lifting and lowering of a person between standing and sitting positions thereon, said inflatable seat comprising at least two inflatable compartments; and the lifting means includes a flow control means for controlling the inflation and/or deflation of each of the compartments as the seat moves between substantially deflated and inflated conditions such that the relative rate of inflation and/or deflation of a compartment at any one time is dependent upon the pressure, fluid in that compartment and the pressure of fluid in the other compartments of the inflatable seat, as the seat moves between deflated and inflated conditions and the person thereon moves between standing and sitting positions.

2. A lifting means according to claim 1 wherein the inflatable seat upon which a person sits includes means for moving the person in two stages such that during inflation the person is lifted in a first stage and in a second stage is pushed forwards towards a standing position.

3. A lifting means according to claim 1 wherein the inflatable seat device is connected to a fluid supply pipe which in turn is connected to a fluid supply.

4. A lifting means according to claim 3 wherein intermediate the fluid supply and the inflatable seat there is provided a control valve to control the fluid supply and a flow valve having means to control the inflation and/or deflation of the compartments of the inflatable seat.

5. A lifting means according to claim 4 wherein the flow valve includes an inlet port to which inflating fluid enters the same, outlets through which the fluid passes into and from connecting feeds to the compartments of the inflatable seat and at least one exit aperture through which fluid exits the valve upon deflation of the inflatable seat.

6. A lifting means according to claim 5 wherein each connecting feed is provided with a flow control means during deflation, said flow control means arranged to be fully open during inflation, but, during deflation, the flow control means are provided to selectively restrict the connecting feeds according to the relative pressures of the compartments of the inflatable seat.

7. A lifting means according to claim 4 wherein the flow valve is provided with an adjustable means such that during inflation and/or deflation of the inflatable seat, the said adjustable means is acted upon by the relative pressures of the fluid in the compartments of the inflatable seat to adjust the proportion of the fluid which is supplied to and/or exits from each of the compartments dependent upon the pressure differentials of the fluid in the compartments of the seat.

8. A lifting means according to claim 7 wherein the adjustable means is a flexible diaphragm which is acted upon by the pressure of fluid in each of the compartments.

9. A lifting means according to claim 8 wherein the diaphragm carries a stop valve assembly including a valve stop for each of the compartments of the inflatable seat.

10. A lifting means according to claim 9 wherein the valve stops are frustoconically shaped and arranged on the diaphragm in relation to the exit apertures of the flow valve to allow control of deflation.

11. A lifting means according to claim 10 wherein the valve stops are provided to be linearly movable in relation to the exit apertures of the flow valve such that as each valve stop moves to or away from the respective exit apertures of the flow valve so they selectively increase or restrict the amount of fluid which can escape through the respective exit apertures.

12. A lifting means according to claim 4 wherein the inlet of the flow valve is provided with a check valve which is closed during deflation and the exit aperture is provided with means to close the same during inflation thereby preventing uncontrolled leakage of fluid from the valve during inflation and deflation.

13. A lifting means according to claim 3 wherein the supply pipe is connected to the inflatable seat via a flow valve which is connected via connecting feed to each of the compartments of the inflatable seat.

14. A lifting means according to claim 1 wherein the inflating fluid is provided in a pressurised form by means of a fluid supply in the form of a blower unit.

15. A lifting means according to claim 1 including means for interconnecting the compartments to allow limited and controlled transfer of fluid between the compartments.

16. A lifting means according to claim 1 wherein said at least two inflatable compartments are separated by an inner wall such that each compartment is independently inflatable and/or deflatable by said flow control means; said flow control means including means for selecting and regulating the supply and escape of fluid to and from the compartments to inflate and deflate the compartments.

17. A lifting means according to claim 16, including means for linking the compartments to allow controlled and limited transfer of fluid between the compartments.

18. A lifting means according to claim 16 wherein the seat is formed from a flexible plastics material to allow movement of the seat from the inflated to the deflated position.

19. A lifting means according to claim 16 wherein the surface on which the person sits is shaped such that there is provided a rear, upstanding section which allows the seat during inflation to exert a lifting action on the person and a pushing forward action to move the person toward a standing position.

20. A lifting means according to claim 16 wherein said inflatable seat includes support arms which can be used to provide support for the person sitting on said seat.

21. A lifting means according to claim 20 wherein the support arms provided to be movable relative to the inflatable seat between a retracted position when the inflatable seat is in a deflated condition and an extended position away from the seat when the seat is inflated to provide support for the person sitting on said seat.

22. A lifting means according to claim 21 wherein the support arms are connected to the seat and arranged to be movable with the seat as it moves between inflated and deflated conditions.

23. A lifting means according to claim 16 wherein the device further includes a frame for contacting a surface and providing additional stability and/or mobility.

* * * * *

UNITED STATES PATENT AND TRADEMARK OFFICE

CERTIFICATE OF CORRECTION

PATENT NO : 5,988,747

DATED : November 23, 1999

INVENTOR(S) : Edward Lewis Jeans

It is certified that error appears in the above-identified patent and that said Letters Patent is hereby corrected as shown below:

On the title page:

In Item [76] on the face of the Patent, please change "Kydart House" to

--Lydart House--

Signed and Sealed this

Twenty-sixth Day of September, 2000

*Attest:*

Q. TODD DICKINSON

*Attesting Officer*

*Director of Patents and Trademarks*